US009494912B2

(12) United States Patent
Mori et al.

(10) Patent No.: US 9,494,912 B2
(45) Date of Patent: Nov. 15, 2016

(54) IMAGE FORMING APPARATUS

(71) Applicant: BROTHER KOGYO KABUSHIKI KAISHA, Nagoya, Aichi (JP)

(72) Inventors: Hirotaka Mori, Aichi (JP); Hiroshi Nakano, Aichi (JP); Noboru Suzuki, Aichi (JP); Shougo Sato, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/084,590

(22) Filed: Mar. 30, 2016

(65) Prior Publication Data

US 2016/0209805 A1 Jul. 21, 2016

Related U.S. Application Data

(63) Continuation of application No. 14/708,438, filed on May 11, 2015, now Pat. No. 9,341,989, which is a continuation of application No. 14/589,570, filed on Jan. 5, 2015, now Pat. No. 9,069,322, which is a (Continued)

(30) Foreign Application Priority Data

Mar. 29, 2010 (JP) ..... 2010-075628

(51) Int. Cl.
*G03G 15/00* (2006.01)
*G03G 21/16* (2006.01)

(52) U.S. Cl.
CPC ..... *G03G 21/1661* (2013.01); *G03G 21/1623* (2013.01)

(58) Field of Classification Search
CPC ..... G03G 21/1661; G03G 21/1623
See application file for complete search history.

(56) References Cited

U.S. PATENT DOCUMENTS 6,937,838 B2 8/2005 Ishii et al.
6,980,761 B2 12/2005 Yamada (Continued)

FOREIGN PATENT DOCUMENTS

JP HEI 03-174571 7/1991
JP HEI 08-227259 9/1996

(Continued)

OTHER PUBLICATIONS

Notice of Allowance dated Nov. 8, 2012 from related U.S. Appl. No. 13/010,988.

(Continued)

*Primary Examiner* — David Gray
*Assistant Examiner* — Michael Harrison
(74) *Attorney, Agent, or Firm* — Scully, Scott, Murphy & Presser, P.C.

(57) ABSTRACT

An image forming apparatus is provided. The image forming apparatus includes a chassis having a first opening on a first side, photosensitive members, an intermediate transfer belt arranged to have a surface thereof facing the photosensitive members, primary-transfer members, a secondary-transfer roller, a first feed roller, a cleaner device, a waste toner container, which is removably installed in the chassis through the first opening and settled in a position opposite from the photosensitive members across the intermediate transfer belt, a connector, a first feeding path extending in a range between the first feed roller and the secondary-transfer roller, and a second feeding path being formed in clearance between the intermediate transfer belt and the waste toner container to convey a recording sheet being inserted through a sheet inlet and merging into the first feeding path in the vicinity of the first feed roller.

10 Claims, 6 Drawing Sheets

Related U.S. Application Data continuation of application No. 14/261,574, filed on Apr. 25, 2014, now Pat. No. 8,989,620, which is a continuation of application No. 13/761,813, filed on Feb. 7, 2013, now Pat. No. 8,750,757, which is a continuation of application No. 13/010,988, filed on Jan. 21, 2011, now Pat. No. 8,385,771.

(56) References Cited

U.S. PATENT DOCUMENTS

| | | | | |
|---|---|---|---|---|
| 7,257,349 | B2 | 8/2007 | Kitozaki | |
| 7,502,577 | B2 | 3/2009 | Kitozaki et al. | |
| 7,603,056 | B2 | 10/2009 | Kamimura | |
| 8,000,628 | B2 | 8/2011 | Sato et al. | |
| 8,139,979 | B2 | 3/2012 | Koishi et al. | |
| 8,270,856 | B2 | 9/2012 | Mizutani et al. | |
| 8,385,771 | B2 | 2/2013 | Mori et al. | |
| 2004/0228664 | A1 | 11/2004 | Yamada | |
| 2005/0281581 | A1 | 12/2005 | Kitozaki | |
| 2005/0281591 | A1 | 12/2005 | Kitozaki et al. | |
| 2008/0267661 | A1 | 10/2008 | Yoshida et al. | |
| 2009/0092429 | A1 | 4/2009 | Yokota | |
| 2009/0226205 | A1 | 9/2009 | Sato et al. | |
| 2010/0059924 | A1* | 3/2010 | Shiohara | B41J 11/485 271/9.01 |
| 2010/0189483 | A1 | 7/2010 | Inoue | |
| 2012/0027438 | A1 | 2/2012 | Mizutani et al. | |

FOREIGN PATENT DOCUMENTS

| | | |
|---|---|---|
| JP | HEI 08-328348 | 12/1996 |
| JP | HEI 11-003015 | 1/1999 |
| JP | 2001-296715 | 10/2001 |
| JP | 2004-233478 | 8/2004 |
| JP | 2004-245874 | 9/2004 |
| JP | 2006-030958 | 2/2006 |
| JP | 2006-153973 | 6/2006 |
| JP | 2007-140144 | 6/2007 |
| JP | 2007-218936 | 8/2007 |
| JP | 2008-134398 | 6/2008 |
| JP | 2009-92858 | 4/2009 |
| JP | 2009-210937 | 9/2009 |
| JP | 2010-8472 | 1/2010 |
| JP | 2010-026050 | 2/2010 |

OTHER PUBLICATIONS

Official Action dated May 28, 2013 from related U.S. Appl. No. 13/761,813.

Official Action dated Oct. 22, 2013 from related U.S. Appl. No. 13/761,813.

Notice of Allowance dated Feb. 6, 2014 from related U.S. Appl. No. 13/761,813.

Notice of Allowance dated Oct. 9, 2014 from related U.S. Appl. No. 14/261,574.

Notice of Allowance dated Feb. 11, 2015 from related U.S. Appl. No. 14/589,570.

Notification of Reasons for Rejection dated Jul. 31, 2012 received from the Japanese Patent Office from related Japanese Application No. 2010-075628, together with an English-language translation.

Official Action dated Jul. 10, 2015 from related U.S. Appl. No. 14/708,438.

* cited by examiner

IMAGE FORMING APPARATUS

CROSS REFERENCE TO RELATED APPLICATIONS

This application is a continuation application of U.S. Ser. No. 14/708,438 filed on May 11, 2015 which is a continuation application of U.S. Ser. No. 14/589,570 filed on Jan. 5, 2015, now U.S. Pat. No. 9,069,322 granted on Jun. 30, 2015, which is a continuation application of U.S. Ser. No. 14/261,574 filed on Apr. 25, 2014, now U.S. Pat. No. 8,989,620 granted on Mar. 24, 2015, which is a continuation U.S. Ser. No. 13/761,813 filed on Feb. 7, 2013, now U.S. Pat. No. 8,750,757 granted on Jun. 10, 2014, which is a continuation application of U.S. Ser. No. 13/010,988 filed on Jan. 21, 2011, now U.S. Pat. No. 8,385,771 granted on Feb. 26, 2013 and claims priority from Japanese Patent Application No. 2010-075628, filed on Mar. 29, 2010, the entire subject matter of each of which are incorporated herein by reference.

BACKGROUND

1. Technical Field

An aspect of the present invention relates to an image forming apparatus, specifically having an intermediate transfer belt, to which a toner image is transferred from a one or more photosensitive members, and a waste toner container, which stores residues such as residual toner removed from the intermediate transfer belt.

2. Related Art

An image forming apparatus having a waste toner container, in which residual toner collected from an intermediate transfer belt is stored, is known. The waste toner container may be arranged below the intermediate transfer belt and removed therefrom through an opening, which is formed on a side surface of a chassis of the image forming apparatus. The image forming apparatus may have a secondary-transfer roller, which serves in cooperation with the intermediate transfer belt to transfer a toner image formed on a surface of the belt to a sheet of paper, and a feed roller, which feeds the sheet from a sheet tray in a feeding path to a nipped position between the intermediate transfer belt and the secondary-transfer roller. The secondary-transfer roller and the feed roller may be arranged in positions on a side opposite from the opening for the waste toner container. Therefore, in such configuration, the feeding path extending from an outlet of the sheet tray to the secondary-transfer roller may be formed on the side opposite from the chassis opening.

SUMMARY

Meanwhile, an image forming apparatus may be configured to have a manual sheet inlet, through which manually-supplied sheets are inserted. With the manual sheet inlet, it is preferable that an opening for the inlet is formed on the same side as the opening for installation and removal of the waste toner container for convenience of handling and installing the image forming apparatus. In such a configuration, an additional feeding path to convey the manually-inserted sheets from the manual sheet inlet to the secondary-transfer roller is required in the chassis, and it is preferable that the additional feeding path is arranged spatially efficiently in the chassis so that a size of the entire image forming apparatus is maintained.

In consideration of the above configuration, the present invention is advantageous in that an image forming apparatus having an opening for manual sheet inlet on the same side as an opening for installation and removal of a waste toner container, wherein a sheet feeding path for manually-inserted sheet is efficiently arranged in a chassis, is provided.

According to an aspect of the present invention, an image forming apparatus to form an image on a recording sheet is provided. The image forming apparatus includes a chassis having a first opening, the first opening being formed on a first side of the chassis, a plurality of photosensitive members, which are set in the chassis and carry toner images, an intermediate transfer belt, which is an endless belt to roll in a predetermined direction, is arranged to have a surface thereof facing the plurality of photosensitive members, and has the toner images on the plurality of photosensitive members transferred onto the surface in cooperation with a plurality of primary-transfer members, a secondary-transfer roller, which is arranged on a second side opposite from the first side within the chassis and transfers the toner images on the surface of the intermediate transfer belt onto the recording sheet, a first feed roller, which is arranged in a vicinity of the second side and conveys the recording sheet toward the secondary-transfer roller, a cleaner device, which is arranged in a position between one of the plurality of photosensitive members being in a most upstream position along the predetermined rolling direction of the intermediate transfer belt and the second transfer roller, to collect residual toner from the surface of the intermediate transfer belt, a waste toner container, which is movable in the chassis to be removably installed in the chassis through the first opening and settled in a position opposite from the plurality of photosensitive members across the intermediate transfer belt, to store the residual toner collected by the cleaner device, a connector, which is connected to the cleaner device, and to which the waste toner container is detachably attached, to convey the residual toner collected by the cleaner device to the waste toner container, a first feeding path, which extends in a range between the first feed roller and the secondary-transfer roller, and a second feeding path, which is formed in clearance between the intermediate transfer belt and the waste toner container to convey a recording sheet being inserted through a sheet inlet toward the first feed roller, the sheet inlet being formed on the first side of the chassis, and merges into the first feeding path in the vicinity of the first feed roller.

According to another aspect of the present invention, an image forming apparatus to form an image on a recording sheet is provided. The image forming apparatus includes a chassis, a plurality of photosensitive members, which are stored in the chassis and carry toner images, an intermediate transfer belt, which is an endless belt arranged to have a surface thereof facing the plurality of photosensitive members and has the toner images on the plurality of photosensitive members transferred onto the surface in cooperation with a plurality of primary-transfer member, a secondary-transfer roller, which transfers the toner images on the surface of the intermediate transfer belt onto the recording sheet, a first feed roller, which conveys the recording sheet in a feeding path toward the secondary-transfer roller, a waste toner container, which stores residual toner removed from the intermediate transfer belt, a first feeding path, which extends in a range between the first feed roller and the secondary-transfer roller, a second feeding path, which is a path for a recording sheet being inserted through a sheet inlet and merges into the first feeding path in the vicinity of the first feed roller. The waste toner container partially defines the second feeding path.

According to still another aspect of the present invention, an image forming apparatus to form an image on a recording sheet is provided. The image forming apparatus includes a chassis having an opening formed on one side of thereof, an intermediate transfer belt, which is an endless belt to roll in a predetermined direction and carries a transferred toner image on a surface thereof, a waste toner container, which is movable in the chassis to be removably installed in the chassis through the opening and settled in a position facing the intermediate transfer belt, to store residual toner removed from the surface of the intermediate transfer belt, a sheet inlet, which is formed on the one side of the chassis, and through which the recording sheet is supplied in the chassis, a feeding path, which is formed in clearance between the intermediate transfer belt and the waste toner container, and a feed roller, which is arranged in a position closer to the one side of the chassis with respect to the intermediate transfer belt within the feeding path, in an overlapping position in a same vertical level at least partially with the intermediate transfer belt, and in a position to at least partially overlap with the waste toner container along a direction of installation and removal of the waste toner container. The waste toner container is formed to have a groove on a plane which faces the intermediate transfer belt when the waste toner container is installed in the chassis. The at least overlapping part of the feed roller is slidable in the groove with respect to the waste toner container when the waste toner container is installed in and removed from the chassis.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

[Overall Configuration of the MFP]

The MFP 1 is a multicolor-enabled MFP, equipped with a plurality of image processing functions including a scanning function, a printing function, a copier function, a facsimile transmission/receiving function, and a function for reading/writing data in a memory medium.

Figure 1:
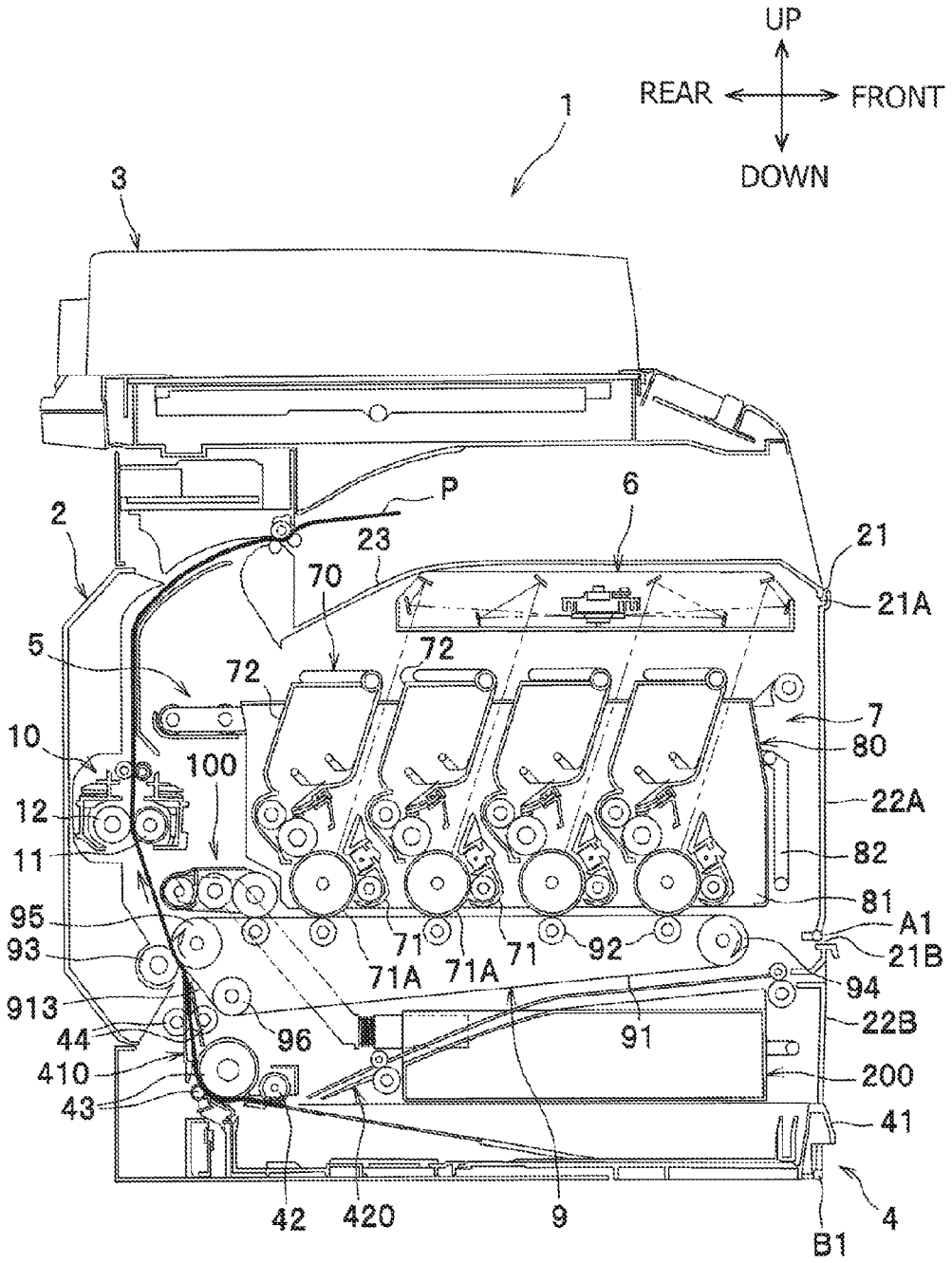
FIG. 1 is a cross-sectional side view of a multicolor MFP (multi-function peripheral) according to an embodiment of the present invention.
Figure 2:
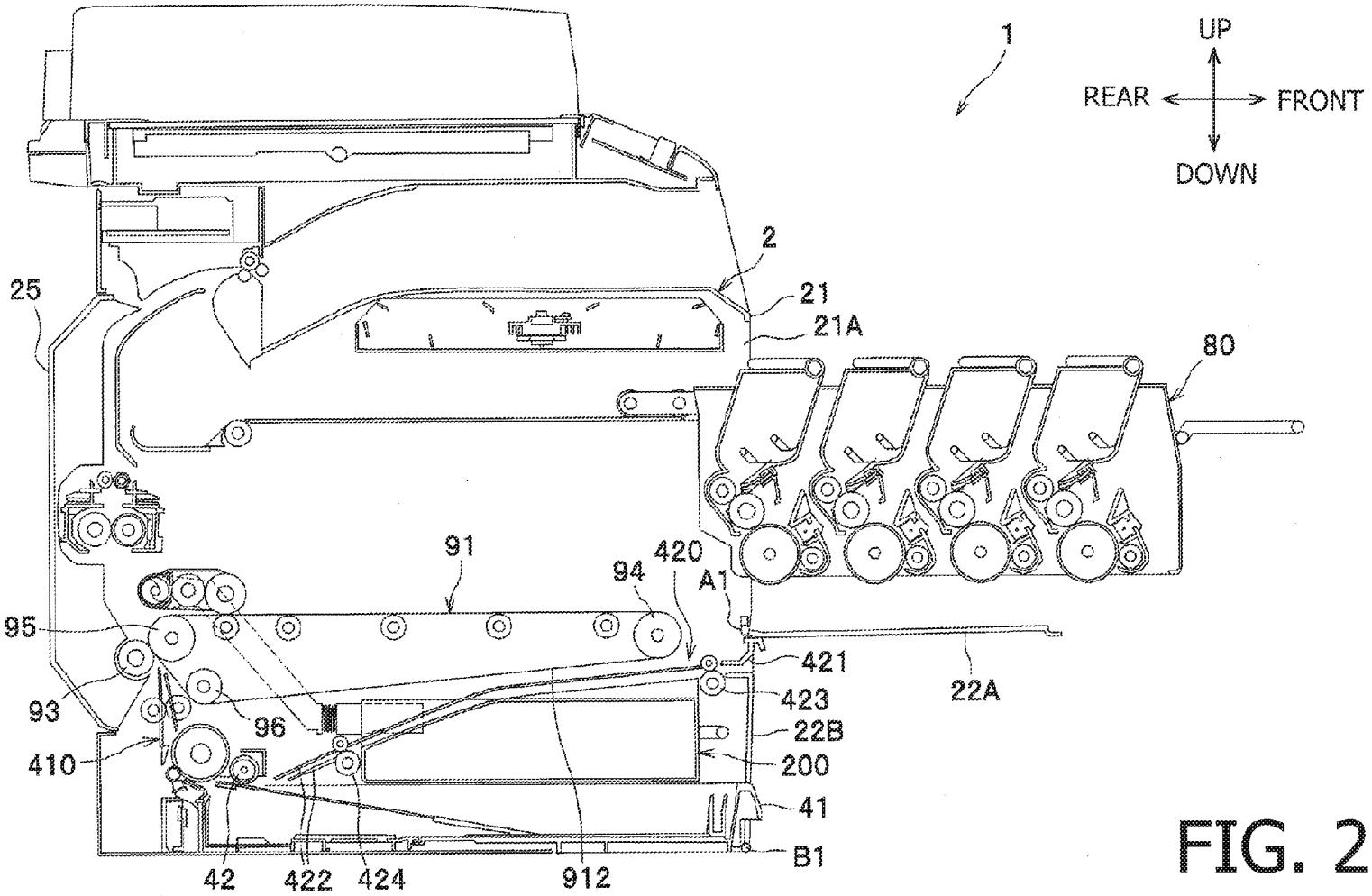
FIG. 2 is a cross-sectional side view of the MFP with a drawer drawn out of a chassis of the MFP according to the embodiment of the present invention.

In the present embodiment, directions concerning the MFP 1 will be referred to in accordance with orientation as indicated by arrows in each drawing. Therefore, for example, a viewer's right-hand side appearing in FIG. 1 is referred to as a front side of the MFP 1, and left-hand side in FIG. 1 opposite from the front side is referred to as rear. A side which corresponds to the viewer's nearer side is referred to as left, and an opposite side from the left, which corresponds to the viewer's further side is referred to as right. The up-down direction in FIG. 1 corresponds to a vertical direction of the MFP. Further, directions of the drawings in FIGS. 2-6 are similarly based on the orientation of the MFP 1 as defined above and correspond to those with respect to the MFP 1 shown in FIG. 1 even when the drawings are viewed from different angles. In cross-sectional views in the accompanying drawings, hatchings are omitted unless specifically required in order to simplify the illustration.

The MFP 1 according to the embodiment includes a chassis 2 and a flatbed scanner 3, which is arranged on top of the chassis 2. The MFP 1 further has a sheet-feed unit 4, which feeds recording sheets P of paper in a sheet feeding path, and an image forming unit 5, which forms images on the sheets P being fed, inside the chassis 2.

The chassis 2 is formed to have a first opening 21A (see FIG. 2) and a second opening 21B (see FIG. 3) on a front side 21 thereof. The first opening 21A is an opening, through which a drawer 80 to hold processing cartridges 70 is settled in and removed from the chassis 2. The second opening 21B is an opening, through which a waste toner container 200 is settled in and removed from the chassis 2. The first opening 21A and the second opening 21B are provided with a first front cover 22A and a second front cover 22B respectively. The first and second front covers 22A, 22B are rotatable about lower edges A1, B1 thereof between open positions (see FIGS. 2 and 3) and closed positions (see FIGS. 3 and 2) to cover and expose the first and the second openings 21A, 21B respectively.

The flatbed scanner 3 is a known document reader, which irradiates light onto a source document to read an image formed thereon and creates image data representing the read image.

The sheet-feed unit 4 is arranged in a lower section of the chassis 2. The sheet-feed unit 4 includes a sheet-feed tray 41, a first feed roller 42, a separator roller 43, and a conveyer roller 44. The sheet-feed tray 41 is a container to store unused sheets P. The first feed roller 42 picks up the sheets P from the sheet-feed tray 41 and is arranged in an upper-rear position with respect to the sheet-feed tray 41. The sheets P having been picked up are separated by the separator roller 43 and conveyed upwardly by the conveyer roller 44 one-by-one to the image forming unit 5.

The image forming unit 5 includes an exposure unit 6, a photosensitive developer unit 7, a belt unit 9, and a fixing unit 10.

The exposure unit 6 is arranged in an upper section in the chassis 2 and includes a laser-beam source (not indicated), a polygon mirror, a lens, and a reflection mirror (not shown). Laser beams emitted from the laser-beam source for yellow, cyan, magenta, and black colors are reflected on the polygon mirrors and the reflection mirrors and transmit through the lenses to be casted to scan on surfaces of photosensitive drums 71A. Double-dotted lines shown in FIG. 1 represent paths of the laser beams.

The photosensitive developer unit 7 is arranged in a lower section with respect to the exposure unit 6 and a higher section with respect to the belt unit 9. The photosensitive developer unit 7 includes four (4) processing cartridges 70, which are aligned in line in a front-rear direction, and a drawer 80, which detachably holds the processing cartridges 70.

Each of the processing cartridges 70 has a drum cartridge 71 in a lower section and a developer cartridge 72, which is detachably attached to a top section of the drum cartridge 71.

The drum cartridge 71 includes a photosensitive drum 71A and a charger (not indicated). Whilst four (4) drum cartridges 71 are aligned in line in the front-rear direction, four (4) photosensitive drums 71A are also aligned in line in the front-rear direction.

Each of the developer cartridges 72 is equipped with a developer roller, a supplier roller, and a toner container (not indicated). Each toner container contains nonmagnetic monocomponent toner in one of cyan, magenta, yellow, and black colors.

The drawer 80 includes a main frame 81, which holds the processing cartridges 70, and a rotatable handle 82, which is arranged on a front side of the main frame 81. The drawer 80 is slidable in the chassis 2 in the front-rear direction to be settled in and removed from the chassis 2 through the first opening 21A (see FIG. 2). In particular, the drawer 80 is movable between an settled position, in which the entire drawer 80 is settled in the chassis 2 (see FIG. 1), and a removed position, in which the drawer 80 is removed out of the chassis 2 (see FIG. 2).

In the photosensitive developer unit 7 configured as above, the charger electrically charges a surface of the photosensitive drum 71A evenly, and the surface of the photosensitive drum 71A is exposed to the laser beam emitted based on image data from the exposure unit 6 in order to form a lower-potential regions, i.e., an electrostatic latent image, thereon.

Meanwhile, the toner in the developer cartridge 72 is supplied to the latent image on the photosensitive drum 71A via the supplier roller and the developer roller. Thus, the latent image is developed to be a toner image carried on the surface of the photosensitive drum 71A.

The belt unit 9 is arranged in a lower position with respect to the photosensitive developer unit 7 and includes an intermediate transfer belt 91, four (4) primary-transfer rollers 92, a secondary-transfer roller 93, a driving roller 94, and two (2) driven rollers 95, 96. In particular, the driven roller 96 is arranged in a rear section of the chassis 2 and in a vertically overlapping position with the driven roller 95. The MFP 1 has a cleaner device 100 and a waste toner container 200, which will be described later in detail, in positions in the vicinities of the belt unit 9.

The intermediate transfer belt 91 is an endless belt extended to roll around rollers 94, 95, 96, which are arranged in a shape of a flat-triangular wedge when viewed from a side, in a clockwise direction in FIGS. 1-3 and FIG. 4A. More specifically, the intermediate transfer belt 91 has a first plane 911, which extends horizontally to face the photosensitive drums 71A and the cleaner device 100, a second plane 912, which extends from a front end portion of the first plane 911 downwardly in an inclined angle (e.g., toward lower left), and a third plane 913, which extends from a rear end portion of the first plane 911 downwardly in an inclined angle (e.g., toward lower right) to meet a front end portion of the second plane 912 (see FIG. 4A). Specifically, the second plane 912 is in contact with the driven roller 96, which is in the rear section of the chassis 2, and extends from the rear section of the chassis 2 in an upward-inclined angle to a section in a vicinity of the front side 21 of the chassis 2.

The intermediate transfer belt 91, the first feed roller 42, and other sheet-feeding components such as a sheet guide (not indicated) are arranged in predetermined positions to have the sheet P conveyed by the first feed roller 42 to become in contact with the third plane 913 of the intermediate transfer belt 91 (see FIG. 1). The sheet P being in contact with the third plane 913 is conveyed by the rolling movement of the intermediate transfer belt 91 along the third plane 913 to a nipped position between the driven roller 95 and the secondary-transfer roller 93. When the sheet P is not carried along the third plane 913 but is carried in a path apart from the intermediate transfer belt 91 until the sheet P becomes in the vicinity of the secondary-transfer roller 93, electricity may be discharged between the third plane 913 of the intermediate transfer belt 91 and the sheet P. However, in the present embodiment, the discharge of electricity can be reduced due to the sheet P being in contact with the intermediate transfer belt 91 at the third plane 913.

The primary-transfer rollers 92 are arranged in positions to oppose the photosensitive drums 71A with the intermediate transfer belt 91 intervening therebetween and in contact with an upper internal surface of the intermediate transfer belt 91. The secondary-transfer roller 93 is arranged on a side opposite from the second opening 21B within the chassis 2 in a position to oppose the secondary-transfer roller 93 via the rear end portion of the intermediate transfer belt 91. When the toner images are transferred to the surface of the intermediate transfer belt 91 and to the sheet P, transfer bias which enables the image transfer is applied to the primary-transfer rollers 92 and the secondary-transfer roller 93 respectively.

In particular, the toner images formed on the photosensitive drums 71A in four colored toners are transferred onto an upper external surface in the first plane 911 of the intermediate transfer belt 91 in layers in cooperation with the rotating primary-transfer rollers 92 and the applied transfer bias. The toner images formed in colors on the intermediate transfer belt 91 are transferred onto the sheet P when the sheet P is conveyed through the section between the intermediate transfer belt 91 and the secondary-transfer roller 93 in cooperation with the rotating secondary roller 93 and the applied transfer bias.

The fixing unit 10 is arranged in an upper position with respect to the secondary-transfer roller 93 and includes a heat roller 11 and a pressure roller 12, which is in a position opposite from the heat roller 11, to press the heat roller 11.

The sheet P with the transferred toner images is carried to a nipped section between the heat roller 11 and the pressure roller 12 in the fixing unit 10 to have the toner images thermally fixed thereon. The sheet P with the fixed image is ejected out of the chassis 2 by discharge rollers (not indicated) and settled in a discharge tray 23.

[Configuration and Surroundings of the Waste Toner Container]

Configuration of the waste toner container 200 and surroundings thereof will be described in detail.

The cleaner device 100, which is connected to the waste toner container 200 by a connector 300 (described later) will be described. The cleaner device 100 is to remove residual toner remaining on the intermediate transfer belt 91 after the image transfer. The cleaner device 100 is arranged in a position between one of the photosensitive drums 711, which is in a most upstream position along a direction of rolling for the intermediate transfer belt 91, and the secondary-transfer roller 93. The cleaner device 100 includes a case 140 accommodating a cleaning roller 110, a collecting roller 120, and an auger 130.

The cleaning roller 110 rotates on the upper external surface of the intermediate transfer belt 91 to remove the residual toner from the surface. In particular, the cleaning roller 110 removes the residual toner in cooperation with a backup roller 111, which is arranged in an opposite position across the intermediate transfer belt 91, with predetermined bias applied to the cleaning roller 110 toward the backup roller 111.

The removed residual toner is passed to the collecting roller 120 as the collecting roller 120 and the cleaning roller 110 rotate. The collecting roller 120 is a roller arranged to have a circumference thereof to be in contact with a circumference of the cleaning roller 110. The collected residual toner is scraped off from the circumference of the collecting roller 120 by a blade 150 and forwarded to an auger room 141, which accommodates the auger 130.

Figure 4A:
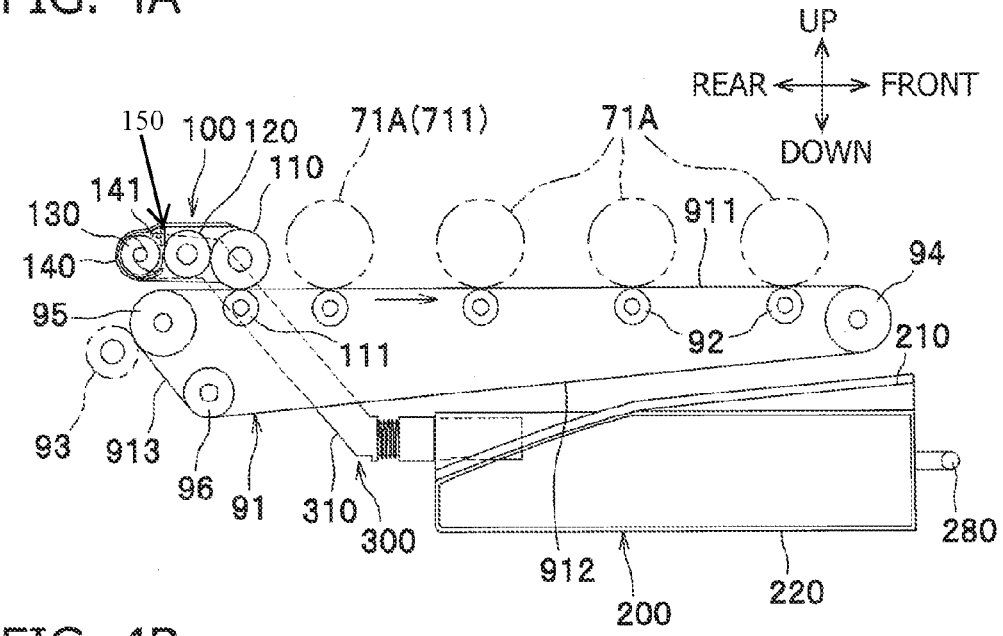
FIGS. 4A and 4B are an illustrative side view and a top plane view of an intermediate transfer belt, a cleaner device, a connector, and the waste toner container in the MFP according to the embodiment of the present invention.
Figure 4B:
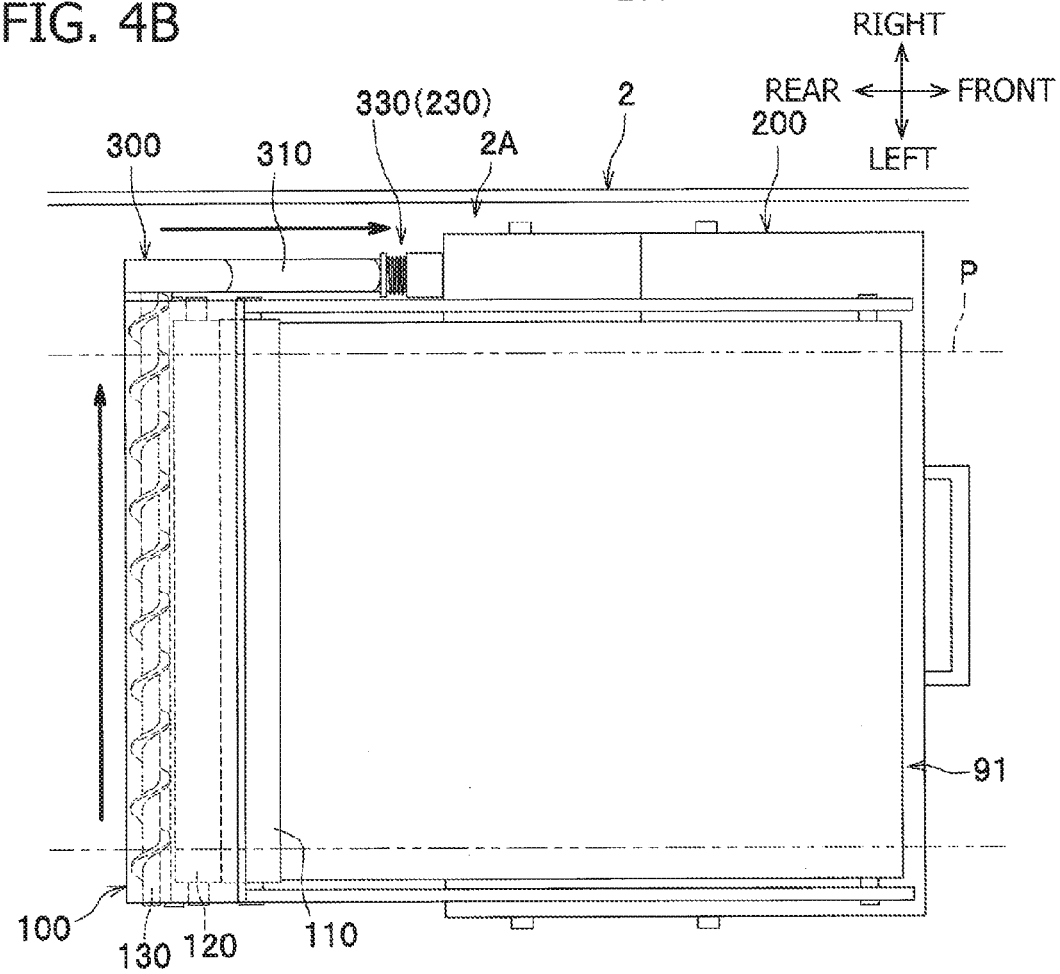
Figure 5A:
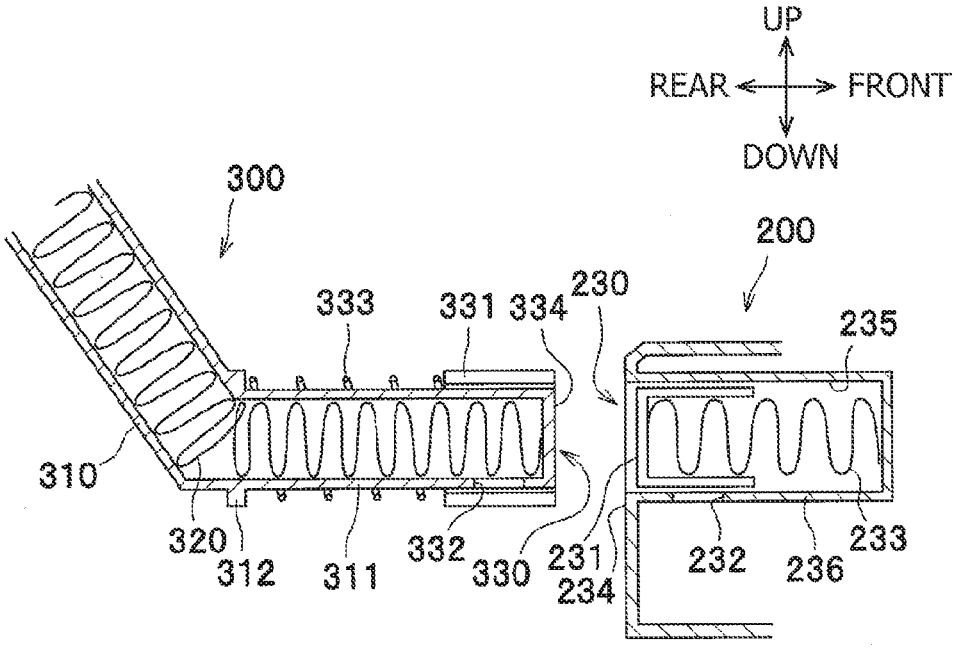
FIG. 5A is a cross-sectional side view of the connector detached from the waste toner container in the MFP according to the embodiment of the present invention.
Figure 5B:
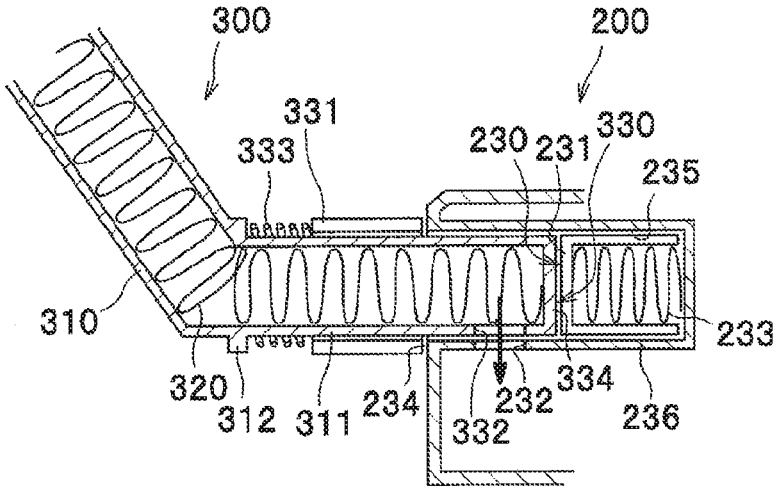
FIG. 5B is a cross-sectional side view of the connector attached to the waste toner container in the MFP according to the embodiment of the present invention.

The auger 130 is a roller having a spiral twining around a shaft (see FIG. 4B). As the auger 130 rotates about the shaft, the residual toner collected in the auger room 141 is carried outside one of widthwise ends of the intermediate transfer belt 91. In the present embodiment, the auger 130 carries the residual toner rightward. The toner carried rightward by the auger 130 is forwarded to the waste toner container 200 via a connector 300. The flow of the collected toner is indicated by thick arrows shown in FIG. 4B.

The connector 300 (see also FIGS. 5A and 5B) connecting the cleaning device 100 with the waste toner container 200 will be described. The connector 300 is a pipe, which is connected to the cleaner device 100 at one end and to which the waste toner container 200 is detachably attached at the other end. The connector 300 includes a shell 310 being a pipe, which is arranged on a left side of the intermediate transfer belt 91 in clearance 2A between the widthwise end of the intermediate transfer belt 91 and the chassis 2. The connector 300 further includes a spring auger 320, which is arranged inside the shell 310 and rotatable within the shell 310 to convey the toner in an axial direction.

The connector 300 includes a connector joint 330 at a front end portion of the shell 310. The joint 330 is attachable to a receptacle joint 230 of the waste toner container 200 when the waste toner container 200 is settled in the chassis 2. Thus, the joints 230, 330 are mutually attachable and arranged in positions to align in the front-rear direction to face each other when the waste toner container 200 is inserted through the second opening 21B and pushed inward to be completely settled.

The joints 230, 330 are provided with covers 231, 331 respectively, which are slidable in the direction of installation and removal of the waste toner container 200 to cover and uncover openings 232, 332 formed in the waste toner container 200 and the shell 310. The covers 231, 331 are pushed in the positions to cover the openings 232, 332 by resiliency of coil springs 233, 333. When the waste toner container 200 is attached to the connector 300, the covers 231, 331 are pushed frontward and rearward respectively by a rear end edge 234 of the waste toner container 200 and a front end surface 334 of the connector 300 against the resiliency of the coil springs 233, 333.

More specifically, the cover 331 of the connector 300 is a cylindrical sleeve and slidable in the front-rear direction with respect to a circumference 311 of the shell 310. Meanwhile, the cover 231 of the waste toner container 200 is formed to have a cylinder with a closed rear end. The cover 231 is arranged in a pit 235 formed in a rear-end section of the waste toner container 200 with an open end thereof facing front and slidable in the front-rear direction with respect to the waste toner container 200 within the pit 235. The opening 332 of the connector 300 is formed in a bottom part of the circumference 311 of the shell 310. The opening 232 of the waste toner container 200 is formed in a bottom part of a circumference 236 of the pit 235. The openings 232, 332 are formed in positions to coincide with each other when the waste toner container 200 is attached to the connector 300.

The coil spring 333 of the connector 300 is arranged in a position between the cover 331 and a flange 312, which is formed to protrude outward from the outer circumference 311 of the shell 310. The coil spring 233 of the waste toner container 200 is arranged between the cover 231 and a closed end of the pit 235. The front end surface 334 of the shell 310 defines a front end surface of the shell 310 and accommodated within an inner diameter of the cover 331. The rear end edge 234 of the pit 235 in the waste toner container 200 is formed to surround the cover 231.

When the waste toner container 200 is attached to the connector 300, the cover 331 is pushed rearward by the rear end edge 234 against the expandable force of the coil spring 333. At the same time, the cover 231 is pushed frontward by the front end surface 334 of the shell 310 against the expandable force of the coil spring 233. Accordingly, the opening 332 of the connector 300 and the opening 232 of the waste toner container 200 coincide with each other to be connected (see FIG. 5A), and the collected toner is allowed to pass through the openings 332, 232 to be carried to the waste toner container 200.

The joints 230, 330 are arranged in a position outside width (length in the right-left direction) of the sheet P being carried in a second feeding path 420 (see FIG. 4B), which will be described later in detail.

Figure 3:
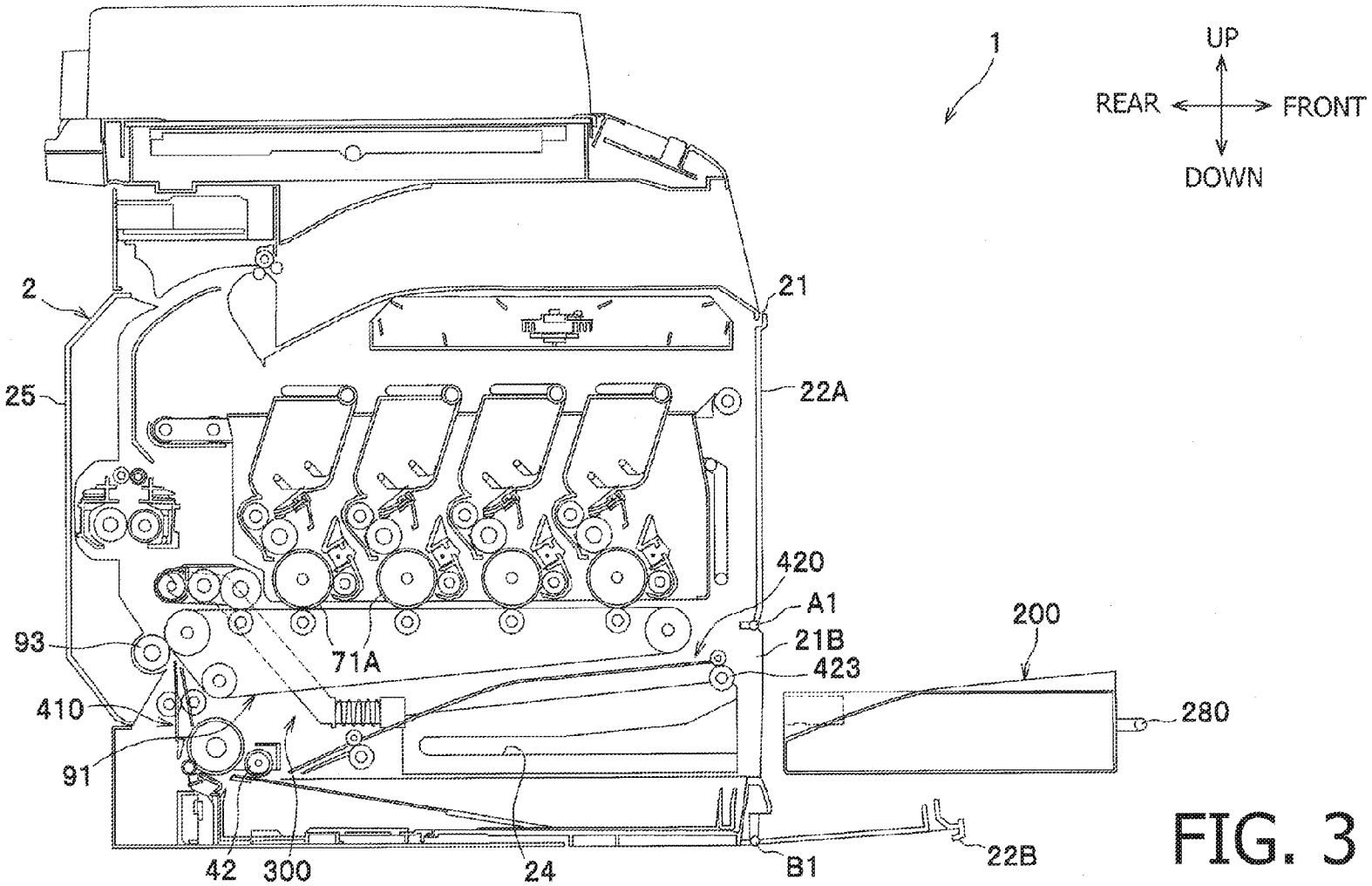
FIG. 3 is a cross-sectional side view of the MFP with a waste toner container removed out of the chassis of the MFP according to the embodiment of the present invention.

The waste toner container 200 accommodates waste toner and is detachably attached to the chassis 2 through the second opening 21B and to the connector 300 (see FIG. 3). When attached, the waste toner container 200 is set in a lower position with respect to the intermediate transfer belt 91 on an opposite side from the photosensitive drums 71A. In other words, the waste toner container 200 and the photosensitive drums 71A are arranged in positions opposite from each other across the intermediate transfer belt 91 (see FIG. 1).

Figure 6:
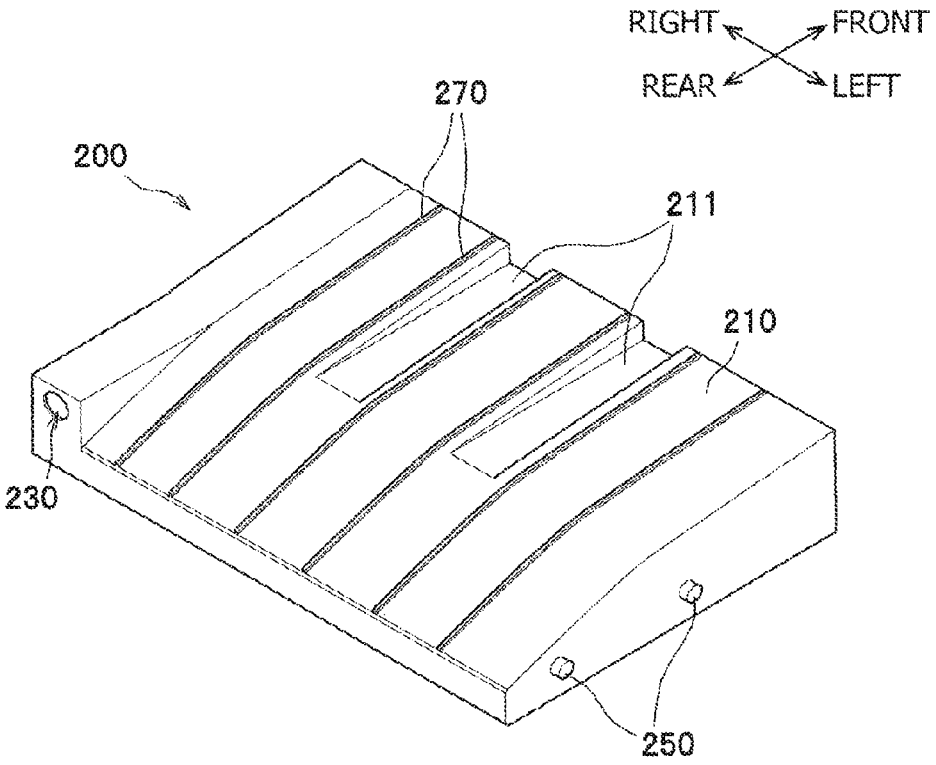
FIG. 6 is a perspective view of the waste toner container from top in the MFP according to the embodiment of the present invention.

As shown in FIG. 4A, the waste toner container 200 is formed to have a wedge-like cross-section having a top plane 210, which faces the second plane 312 of the intermediate transfer belt 91 and extends there-along, and a bottom plane 220, which extends in parallel with the first plane 911 of the intermediate transfer belt 91 (see FIG. 6). More specifically, the top plane 210 is inclined upwardly toward front with a rear end thereof being lower than a front end thereof. A front side of the waste toner container 200 comes in the vicinity of the driving roller 94 and extends in parallel with a second front cover 22B (see FIG. 1) when the waste toner container 200 is settled in the cassis 2. Further, the waste toner container 200 is formed to have the joint 230 on a rear side thereof (see FIG. 6).

Further, the waste toner container 200 is formed to have a pair of guide pins 250 (see FIG. 6, in which solely a pair is shown), which project outwardly, on each of a right side surface and a left side surface of the waste toner container 200. As the waste toner container 200 is installed in the chassis 2 through the second opening 21B, the guide pins 250 are inserted in guide grooves 24, which are formed on left side and right side inner surfaces, and the waste toner container 200 is smoothly guided to a position, in which the waste toner container 200 is attached to the connector 300. The guide grooves 24 are formed to have height thereof to be smaller in an area closer to the rear of the chassis 2 and greater in an area closer to the front of the chassis 2 so that the guide pins 250 are more easily received in the guide grooves 24 in the area closer to the front.

Furthermore, the waste toner container 200 is formed to have ribs 270 (see FIG. 6), which protrudes upwardly from an outer surface of the top plane 210. The ribs 270 are formed to face a second feeding path 420, when the waste toner container 200 is installed, and serve to guide the sheet being carried in the second feeding path 420. In other words, the ribs 270 form a part of the second feeding path 420. The second feeding path 420 will be described below in detail.

The waste toner container 200 is further formed to have dented grooves 211, in which roller parts of a second feed roller 423 (see FIG. 3) can slide with respect to the waste toner container 200 when the waste toner container 200 is installed in and removed from the chassis 2, to avoid interference between the waste toner container 200 and the second feed roller 423. Furthermore, the waste toner container 200 is formed to have a handle 280, which can be grabbed to be handled by a user, on the front side thereof.

The second feeding path 420 is formed in clearance between the waste toner container 200 and the intermediate transfer belt 91. The second feeding path 420 is a path for a manually-supplied sheet and extends from the front side 21 toward the rear side 25 of the chassis 2. The second feeding path 420 merges into a first feeding path 410, which ranges between the first feed roller 42 and the secondary-transfer roller 93.

More specifically, the second feeding path 420 includes a manual sheet inlet 421, sheet-feed guides 422, the second feed roller 423, and a conveyer roller 424. The manual sheet inlet 421, through which the sheet is manually inserted, is an opening formed in the second front cover 22B. The sheet-feed guides 422 are guiding plates, which extend from the manual sheet inlet 421 to the vicinity of the first feed roller 42. The sheet-feed guides 422 are arranged to have clearance therebetween for the manually-supplied sheet to pass therethrough. The sheet is conveyed in the second feeding path 420 in the clearance between the sheet-feed guides 422 by the second feed roller 423 and the conveyer roller 424 to the vicinity of the first feed roller 42 and further fed in the first feeding path 410.

The second feed roller 423 is arranged in a position within the second feeding path 420 closer to the front with respect to the waste toner container 200 and in a horizontally (i.e., in the direction of installation and removal of the waste toner container 200) overlapping position at least partially with the intermediate transfer belt 91 (specifically with the second plane 912) and with the waste toner container 200. In particular, the second feed roller 423 is in a horizontally overlapping position (i.e., substantially in a same vertical level) at least partially with the lower part (i.e., the section surrounding the driven roller 96) of the intermediate transfer belt 91 and in a position inside the chassis 2 and outer side than the intermediate transfer belt 91 (i.e., between the intermediate transfer belt 91 and the front side 21) along the front-rear direction. Even in the overlapping positions, however, when the waste toner container 200 is installed in and removed from the chassis 2, the waste toner container 200 is moved in the front-rear direction along the guide grooves 24 with the grooves 211 allowing the roller parts of the second feed roller 423, which horizontally overlap with the waste toner container 200 and otherwise interfere with the waste toner container 200, to slide therein without being interfered with by the second feed roller 423. In other words, with the simple configuration of the grooves 211 formed on the top plane 210, the second feed roller 423 can be arranged in the horizontally overlapping position with the intermediate transfer belt 91 and the waste toner container 200. Thus, the waste toner container 200 can be installed in and removed from the chassis 2 through the second opening 22B more easily than a waste toner container, which is installed in and removed from a chassis having the second feed roller 423 arranged in a not overlapping position with the intermediate transfer belt 91, for example, in a position closer to the sheet-feed tray 4 but interfering with the waste toner container 200.

According to the above configuration, with the second feeding path 420 formed in between the intermediate transfer belt 91 and the waste toner container 200, the second feed roller 423 to convey the sheet in the second feeding path 420 can be spatially efficiently arranged in the space between the intermediate transfer belt 91 and the second front cover 22B in the chassis 2. Nevertheless, when the second feed roller 423 interferes with the waste toner container 200, the waste toner container 200 may prevent the interference by having the grooves 211 on the top plane 210 thereof, which faces the second feeding path 423 when the waste toner container 200 is in the chassis 2. In this configuration, the waste toner container 200 can be smoothly installed in and removed from the chassis 2 without the interference of the second feed roller 423.

According to the above configuration, the ribs 270 formed on the outer surface of the top plane 210 of the waste toner container 200 serve as a guide for the sheet in the second feeding path 420. Therefore, when the waste toner container 200 is removed out of the chassis 2, the second feeding path 420 is exposed through the second opening 21B. Accordingly, when the sheet is stuck in the second feeding path 420, the user can access the second feeding path 420 simply by removing the waste toner container 200 out of the chassis 2 to remove the jammed sheet. Further, when the waste toner container 200 is removed out of the chassis 2, and the second feeding path 420 is exposed, the sheet-guide 422 prevents the intermediate transfer belt 91 from being touched by the jammed sheet or by the user whilst touching the intermediate transfer belt 91 may damage the intermediate transfer belt 91 and cause image-forming errors.

According to the above configuration, the drawer 80 holding the processing cartridges 70 is removable through the first opening 21A, which is formed on the same side in the chassis 2 as the second opening 21B. Therefore, when exchange of the processing cartridges 70 is required, the user can access the processing cartridges 70 from the same side of the chassis 2 as the side, from which the user accesses the waste toner container 200 and the manual sheet inlet 421. Thus, the user's convenience for handling the MFP 1 is improved.

Further, although the MFP 1 may be restricted to have the front side open to be accessible so that the user can easily access the first and second openings 21A, 21B, and the manual sheet inlet 421, the MFP 1 may not necessarily be arranged to have the other three (rear, left, right) sides open but may be arranged in a location, for example, in which the three sides face walls. Thus, the MFP 1 may be advantageously located even in a restrictive smaller place.

According to the above configuration, the waste toner collected by the cleaner device 100 is conveyed sideward by the auger 130 to the right. The waste toner is further carried to the waste toner container 200 by the connector 300, which is arranged in the clearance 2A formed on the right side of the intermediate transfer belt 91. Therefore, the waste toner can be efficiently carried in a shorter distance from the cleaner device 100 to the waste toner container 200. With the minimum configuration to carry the waste toner, the MFP 1 can be downsized.

According to the above configuration, the joints 230, 330 are arranged in the positions to oppose to each other in line in the installation/removal direction of the waste toner container 200. Accordingly, the structure of the connector 300 can be simplified compared to a connector with joints being arranged to oppose to each other in right-left direction, which is perpendicular to the installation/removal direction of the waste toner container 200.

According to the above configuration, the joints 230, 330 are arranged outside the width of the sheet being carried in the second feeding path 420. Accordingly, even if the waste toner leaks through the joints 230, 330, the toner may not necessarily fall on the sheet being carried, and the sheet is prevented from being ruined by the leaked toner.

According to the above configuration, when the joint 230 is detached from the joint 330, the covers 231, 331 are automatically moved in the positions to cover the openings 232, 332. Thus, fall of the toner from the openings 232, 332 is prevented. Further, the connector 300 is efficiently handled by the automatic closing/opening structure of the covers 231, 331. For example, compared to joints having covers, which are manually moved by separately provided manipulation members, the structure of the connector 300 in the above embodiment is more simplified.

According to the above configuration, the sheet P being carried by the first feed roller 42 becomes in contact with the third plane 913 of the intermediate transfer belt 91 before the sheet P enters the nipped position between the intermediate transfer belt 91 and the secondary-transfer roller 93. Therefore, the electrical discharge between the third plane 913 and the sheet P can be reduced.

According to the above configuration, with the intermediate transfer belt 91 having the wedge-shaped cross-section and the waste toner container 200 having the wedge-shaped cross-section, which are arranged in the vertically overlapping positions to substantially form a rectangular solid, the space inside the chassis 2 is efficiently used. Accordingly, the chassis 2 of the MFP 1 can be downsized in the height thereof.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, although in the above embodiment, the first opening 21A for the drawer 80 and the second opening 21B for the waste toner container 200 are separately formed, a single and larger opening to allow the installation and removal of both the drawer 80 and the waste toner container 200 may be formed, and a single cover to cover the larger opening may be provided.

For another example, the side, in which the first opening 21A, the second opening 21B, and the manual sheet inlet 421 are formed, may not necessarily be the front side, but may be the right or the left side. Further, the photosensitive drums 71A may be replaced with, for example, photosensitive belts.

The structures of the cleaner device 100 and the connector 300 may not be limited to those described above. For example, a cleaner device 100 without the collecting roller 120 may be used. Alternatively or additionally, a connector 300 without the spring auger 320 may be employed. Furthermore, a connector 300 may be provided with a cover being slidable along a plane, in which the opening is formed.

Further, for example, the auger 130 with the spiral may be replaced with a spring auger.

The embodiment described above may not necessarily be applied to a multicolor MFP, but may be employed in, for example, a printer and a copier. Further, the sheet may not necessarily be paper but may be, for example, an OHP sheet.

Furthermore, the primary-transfer rollers 92 may be replaced with, for example, conductive brushes or conductive blade springs, as long as the primary-transfer members are capable of bearing the applied transfer bias.

What is claimed is:

1. An image forming apparatus configured to form toner images on a recording sheet, comprising:

a chassis formed to have an opening on one side thereof;

a drawer configured to support a plurality of processing cartridges and configured to be movable in a predetermined movable direction between a first position, wherein the drawer is installed in the chassis, and a second position, wherein the drawer is moved from the first position in the predetermined movable direction;

an intermediate transfer belt unit disposed below the drawer, the intermediate transfer belt unit including an endless belt;

a sheet feed tray configured to support the recording sheet;

a first conveyer path extending from the sheet feed tray to the endless belt;

a second conveyer path arranged between the sheet feed tray and the endless belt, the second conveyer path being merged into the first conveyer path;

a conveyance guide removably arranged between the sheet feed tray and the endless belt, the conveyance guide defining a part of the second conveyer path, the conveyance guide comprising a guide rib on an upper surface thereof, the guide rib being configured to guide the recording sheet;

a guide groove portion disposed between the drawer and the sheet feed tray, the guide groove portion being configured to guide the conveyance guide to be removable in a direction toward the one side of the chassis.

2. The image forming apparatus according to claim 1, wherein the conveyance guide comprises a guide pin configured to be inserted in the guide groove portion;

wherein the conveyance guide comprises a handle on one side thereof which is closest to the one side of the chassis when the conveyance guide is arranged in the chassis;

wherein a dimension of the guide groove portion is greater in an area closer to the handle and smaller in an area farther from the handle; and wherein a conveyer roller is arranged on the second conveyer path.

3. The image forming apparatus according to claim 2, wherein the guide pin is formed to project outward from a side surface of the conveyance guide, the side surface spreading orthogonally to the predetermined movable direction.

4. The image forming apparatus according to claim 1, further comprising:

a cleaner device configured to clean a surface of the endless belt, the cleaner device being configured to convey toner collected from the surface of the endless belt;

wherein the conveyance guide is a container to contain the toner collected from the surface of the endless belt and conveyed by the cleaner device.

5. The image forming apparatus according to claim 1, further comprising:

a cover configured to cover the opening, the cover being configured to be movable to allow the conveyance guide to be moved with respect to the chassis through the opening.

6. The image forming apparatus according to claim 1, wherein the conveyer roller is arranged in a horizontally overlapping position at least partially with the endless belt.

7. The image forming apparatus according to claim 6, wherein the conveyer roller is configured to convey the recording sheet toward the first conveyer path through the second conveyer path.

8. The image forming apparatus according to claim 6, wherein the conveyance guide is formed to have a slider-groove on the upper surface thereof;

wherein at least an overlapping part of the conveyer roller to horizontally overlap the endless belt is slidable in the slider-groove with respect to the conveyance guide when the conveyance guide is removed.

9. The image forming apparatus according to claim 1, wherein the endless belt and the conveyance guide are arranged in at least partially mutually overlapping positions vertically.

10. The image forming apparatus according to claim 1, wherein the conveyance guide is arranged in a horizontally overlapping position at least partially in a same vertical level with the second conveyer path.

* * * * *